US005323876A

United States Patent [19]

McAllister et al.

[11] Patent Number: 5,323,876

[45] Date of Patent: Jun. 28, 1994

[54] ELEVATOR DOOR MECHANISM

[76] Inventors: Emory C. McAllister, 1550 E. County Rd. H2; Jerome C. Perron, 5959 E. County Line Rd., both of White Bear Lake, Minn. 55110

[21] Appl. No.: 923,492

[22] Filed: Aug. 3, 1992

[51] Int. Cl.[5] ..... B66B 13/06

[52] U.S. Cl. ..... 187/53; 187/52 R; 187/56; 49/102

[58] Field of Search ..... 49/100, 101, 102, 118, 49/123, 360; 187/52 R, 51, 53, 56

[56] References Cited

U.S. PATENT DOCUMENTS

| | | | |
|---|---|---|---|
| 1,145,881 | 7/1915 | Doyle | 187/52 R X |
| 1,467,247 | 9/1923 | Jarnig | 187/52 R |
| 2,425,016 | 8/1947 | Weaver | 49/102 |
| 2,841,390 | 7/1958 | Urquhart | 49/102 |
| 3,045,747 | 7/1962 | Hill | 49/118 X |
| 3,261,128 | 7/1966 | Slopa et al. | 49/118 X |
| 3,406,484 | 10/1968 | Atkey et al. | 49/363 |
| 3,431,678 | 3/1969 | Stuart et al. | 49/360 |

FOREIGN PATENT DOCUMENTS

| | | |
|---|---|---|
| 465281 | 1/1992 | European Pat. Off. . |
| 86985 | 7/1936 | Sweden . |
| 1410681 | 10/1975 | United Kingdom . |

*Primary Examiner*—Robert P. Olszewski
*Assistant Examiner*—Dean A. Reichard
*Attorney, Agent, or Firm*—Kalish & Gilster

[57] ABSTRACT

An elevator door mechanism that has a rotating shaft, a reversible driving means to turn the shaft, a linear drive actuator riding on and moving along the shaft, a resilient isolated pillow block mounted on spacers at each end of the shaft to dampen the noise of operation, two elevator doors attached to the linear drive actuator, and a switching means attached adjacent to one end of the rotating shaft to indicate the doors are closed and a switching means attached adjacent to the other end of the rotating shaft to indicate the doors are open, wherein the actuator is attached to the shaft with pitched bearings and the closing force of the linear actuator is controlled by pressure springs on the linear actuator.

7 Claims, 4 Drawing Sheets

ELEVATOR DOOR MECHANISM

THE FIELD OF THE INVENTION

The present invention relates to the automatic opening and closing of elevator doors, such as those used by the handicapped for accessibility in private residences. More specifically, the present invention relates to an elevator door mechanism that is conveniently activated by a push button located adjacent to each landing and within the car. The elevator doors open a full 34 inches (86.36 cm), which is the standard cab width for elevators used by the handicapped, with a minimal amount of noise. It can operate using a standard 120 AC voltage which is typically available in residences.

BACKGROUND OF THE INVENTION

Most of the elevators installed for handicapped accessibility in private residences have swing doors and a collapsible gate on the elevator cab. Some handicapped accessibility elevators have a power operated swing door at each floor, that is a standard passage door that is swung outward to permit access to the elevator. The problem with automatic swing doors is that a handicapped individual who is entering the elevator in a wheel chair has to position himself far enough away from the door to permit it to swing to its fully open position.

Another problem with the power activated swing door is that once it is open, the passenger still has to manually open the horizontally sliding collapsible gate of the elevator cab to gain entrance. The present invention will permit the automatic opening of the car and the hall doors the full width of the elevator cab by activation of a door open button that is adjacent to each landing entrance.

The commercial passenger elevator has horizontal sliding doors in the car and the hall. The commercial door operators, as in U.S. Pat. No. 3,406,484, require a DC motor that through a series of pulleys and arm linkage are attached to the elevator cab doors to open and close horizontally. This device is not practical on private residence installations, because a sophisticated electrical control is required to operate the direct current motor and the complicated mechanical drive mechanism is too large to be installed on a 3 foot (91.44 cm) by 4 foot (121.92 cm) handicapped residential elevator. The present invention utilizes normal private residence 120 V AC single phase power to operate the doors horizontally.

U.S. Pat. No. 3,431,678 discloses a linear drive actuator that is designed to apply a variable pressure by use of a spring carriage mounted to the actuator block. The spring carriage passes over a system of cams that are used to vary the pressure of the linear drive rollers as they rotate on the shaft. This reference fails to disclose the mechanism of the present invention, which sets the linear actuator for constant pressure along the full travel of the shaft with pitched bearings and adjusts the pressure springs on the linear actuator to provide a kinetic energy of the moving doors of under 2.5 ft-lbs (3.39 newton-meters). This kinetic energy setting is a requirement of Rule 112.4 and 112.5 of the American National Standards Safety Codes for Elevators and Escalators, ANSI A17.1, 1990 edition.

Neither of the above references discloses the conveniently activated and accessible elevator door mechanism of the present invention.

SUMMARY OF THE INVENTION

The present invention is an elevator door mechanism for use in a private residence comprising (a) a rotating shaft, (b) a reversible driving means to turn the shaft, (c) a linear drive actuator riding on and moving along the shaft, (d) a resilient isolated pillow block mounted on spacers at each end of the shaft to dampen the noise of operation, (e) two elevator doors attached to the linear drive actuator, and (f) a switching means attached adjacent to one end of the rotating shaft to indicate the doors are closed and a switching means attached adjacent to the other end of the rotating shaft to indicate the doors are open, wherein the actuator is attached to the shaft with pitched bearings and the closing force of the linear actuator is controlled by pressure springs on the linear actuator.

THE FIGURES

An embodiment of the present invention is disclosed in FIGS. 1 through 5.

A DETAILED DESCRIPTION OF THE INVENTION

Figure 1:
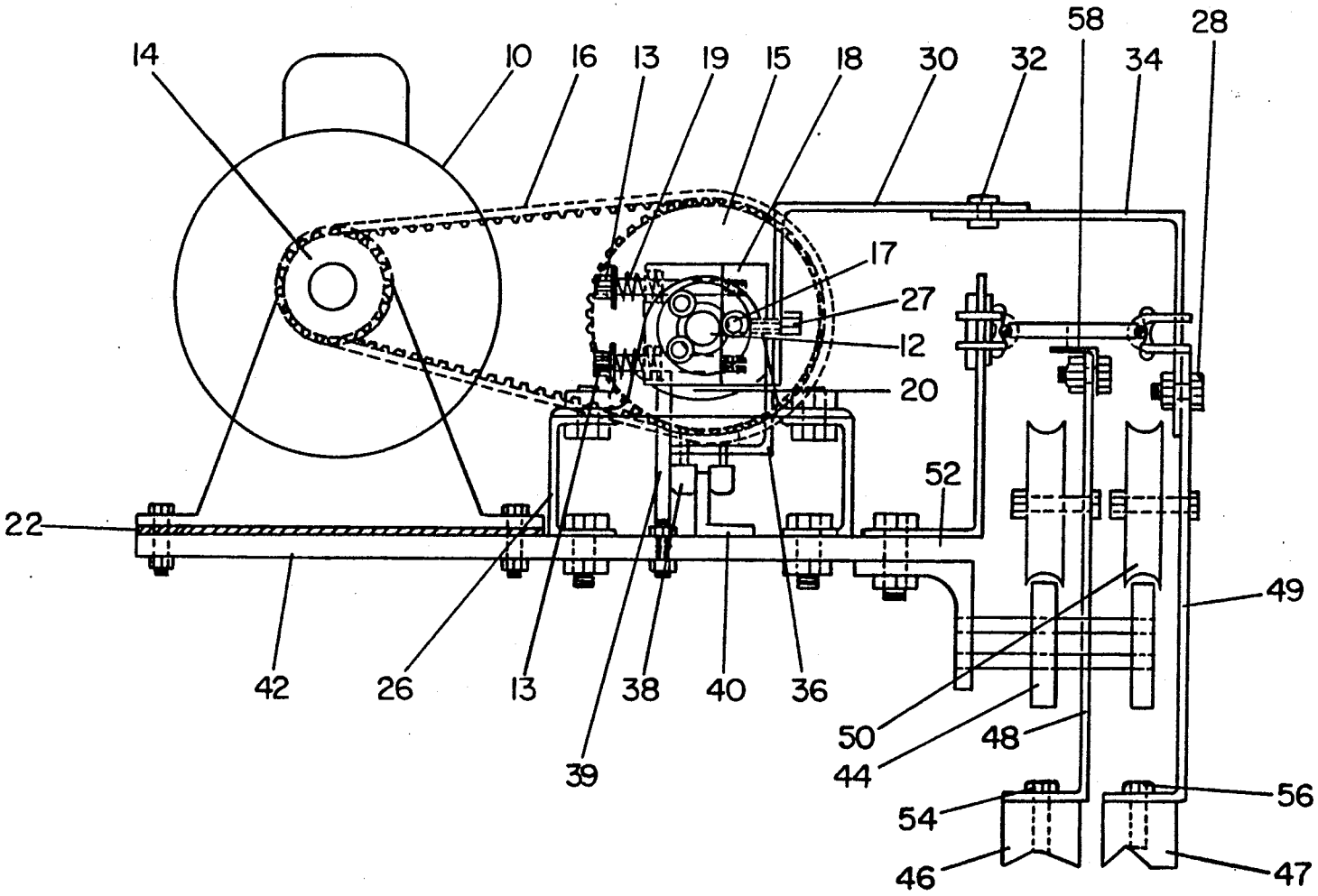
FIG. 1 is an end view of an embodiment of the present invention.

The shaft of the present invention is made from steel, hardened steel, hardened stainless steel or non-hardened stainless steel. Preferably, the shaft is a stainless steel shaft of between ⅜ inch (0.8 cm) and ⅝ inch (1.2 cm) in diameter. Most preferably, the shaft is a ½ inch (1.27 cm) stainless steel Rockwell C 60 hardened shaft, because it is less susceptible to wear and corrosion.

The reversible driving means to turn the shaft can be any means that can provide between about 500 and 1700 rpm, such as an electric motor, an electric motor with gear reduction unit, or an electric motor with rpm reduction sheaves. Preferably, an AC 120 V motor is used, since 120 V AC is readily available in most residences. The most preferred reversible driving means is an instant reversing AC 120 V motor, because it provides both the door open and door close cycle without manually reversing the drive motor.

The linear drive actuator of the present invention rides on and moves along the shaft, and is a size 2, 3 or 4 as commonly known in the elevator door industry. The most preferred linear actuator is a size 3 that has six ball bearings, three at each end of a two-piece aluminum block. Mounted at a lead angle, relative to the drive shaft axis, the bearings convert drive shaft revolution into proportional linear travel or "lead". The linear thrust capability is created by the friction between the smooth surfaces of the angled bearings and the drive shaft. Thrust capacity is varied by adjusting the spring compression cap screws. Loads exceeding the thrust setting cause the bearings to slip and stop advancing the actuator even though the drive shaft continues turning. An example of a suitable linear drive actuator is disclosed in U.S. Pat. No. 3,431,678.

The resilient isolated pillow block located at each end of the shaft is an isolated bearing, with a ½ inch (1.27 cm) inside diameter. The isolation bearing is encased in a stamped steel mounting frame. Preferably, the isolated pillow block is made of rubber, such as Neoprene rubber or polyurethane. The most preferred isolated pillow is a polyurethane isolation, part number 700674, manufactured by Sealmaster.

The resilient isolated pillow block is mounted to a spacer to dampen the noise of operation. The spacer can be made of metal, wood or plastic. The shape of the spacer can be an angle, a block or a channel. Preferably, the spacer is made of aluminum in the shape of a channel, because it is more resistent to resonant vibration transfer than other materials. At the end of each open and close cycle the linear actuator is stopped by a pair of padded vertical projections, such as bolts that are attached to the bed plate and in front of each pillow block. These padded projections prevent the linear actuator from striking the pillow blocks, thus preventing damage to the actuator and further reducing noise. The bolts are adjustable to stop the movement of the linear actuator when the doors are in a full open or full close position.

The two speed elevator doors of the present invention that are attached to the actuator are two panel, 6 foot, 8 inch (203.2 cm) high by 1 foot, 5⅞ inch (45.09 cm) wide. The doors can be made of formed steel, plastic, hollow core wood or solid core wood panels that are 1¼ inch (3.2 cm) thick. Preferably, the doors are made of hollow or solid core wood, because they are the most popular type of door used in residential construction. The most preferred doors are solid core wood doors 1 foot, 5⅞ inch (45.09 cm) wide.

The switching means that is adjacent to the ends of the rotating shaft to close the door is any means that serves to start and stop the reversible driving means. The preferred switching means is a BX-2RW82-A2 instantaneous switch manufactured by Micro Switch, because this switch is provided with an instantaneous on/off mechanism and is activated by use of a roller mounted to the end of the activating mechanism.

An end view of an embodiment of the present invention is disclosed in FIG. 1. A smooth rotating shaft 12 turning at a fixed number of rpms (Hz), in the range of about 500 to 1700, preferably 850 rpm, and a linear actuator 18 attached to this shaft with six (6) pitched bearings 17, made from hardened bearing steel. The pitched bearings 17 make contact with the rotating shaft 12 and move the linear actuator 18 along the shaft at a precise speed, depending on the lead pitch of bearings 17. The precise speed of the actuator 18 can vary from about 2.83 inches/s (7.19 cm/s) to 14.16 inches/s (35.97 cm/s), preferably, the speed is 7.08 inches/s (17.98 cm/s). The closing force of the linear actuator 18 is controlled by adjustments of pressure springs 19. The pressure springs are 1 inch (2.54 cm) long, with a diameter of ⅝ inch (1.59 cm), and can be adjusted by the turning of the adjusting set screws 13. The rated thrust, in pounds, can be varied depending on the compression of the pressure spring. This permits slippage on the smooth shaft if the resistance to linear motion is encountered. This thrust is adjustable from 0 (no resistance) to no slippage (infinite thrust), depending on the compression of the springs. The preferred thrust setting is between about 1.5 pounds (6.67 newtons) and 15 pounds (67.5 newtons). The most preferred thrust rating is 2.5 pounds (11.12 newtons), because this pressure will permit slippage if the elevator doors come in contact with an exiting or entering passenger.

The present embodiment has timing belt sheaves 14 and 15 configured at a ratio in the range of from, 5:1 to 1:1, because the variable rpm's of the shaft are directly proportional to the linear speed of the actuator. Preferably, the sheaves are configured at a ratio of about 2:1, with sheave 14 having 30 teeth and sheave 15 having 60 teeth. Timing belt sheave 15 is attached to the end of shaft 12. The timing belt sheaves 14 and 15 are connected by a timing belt 16 that is rotated by an instant reversing AC 120 V motor 10.

Timing belt sheave 14 is rotated at about 1700 rpm (Hz), and timing belt sheave 15 rotates at from about 340 rpm to about 1700 rpm (Hz). Preferably, the ratio of rotation of timing belt sheave 14 to that of timing belt sheave 15 is in the range of about 1:1 to 5:1. The most preferred rotation for timing belt sheave 14 is about 1700 rpm, and for timing belt sheave 15 is about 850 rpm, having a ratio of rotation of about 2:1. When the shaft 12 is rotated at 850 rpm, the linear actuator 18 moves along the shaft 12 at a precise speed of 7.08 inches/s (17.98 cm/s).

Figure 2:
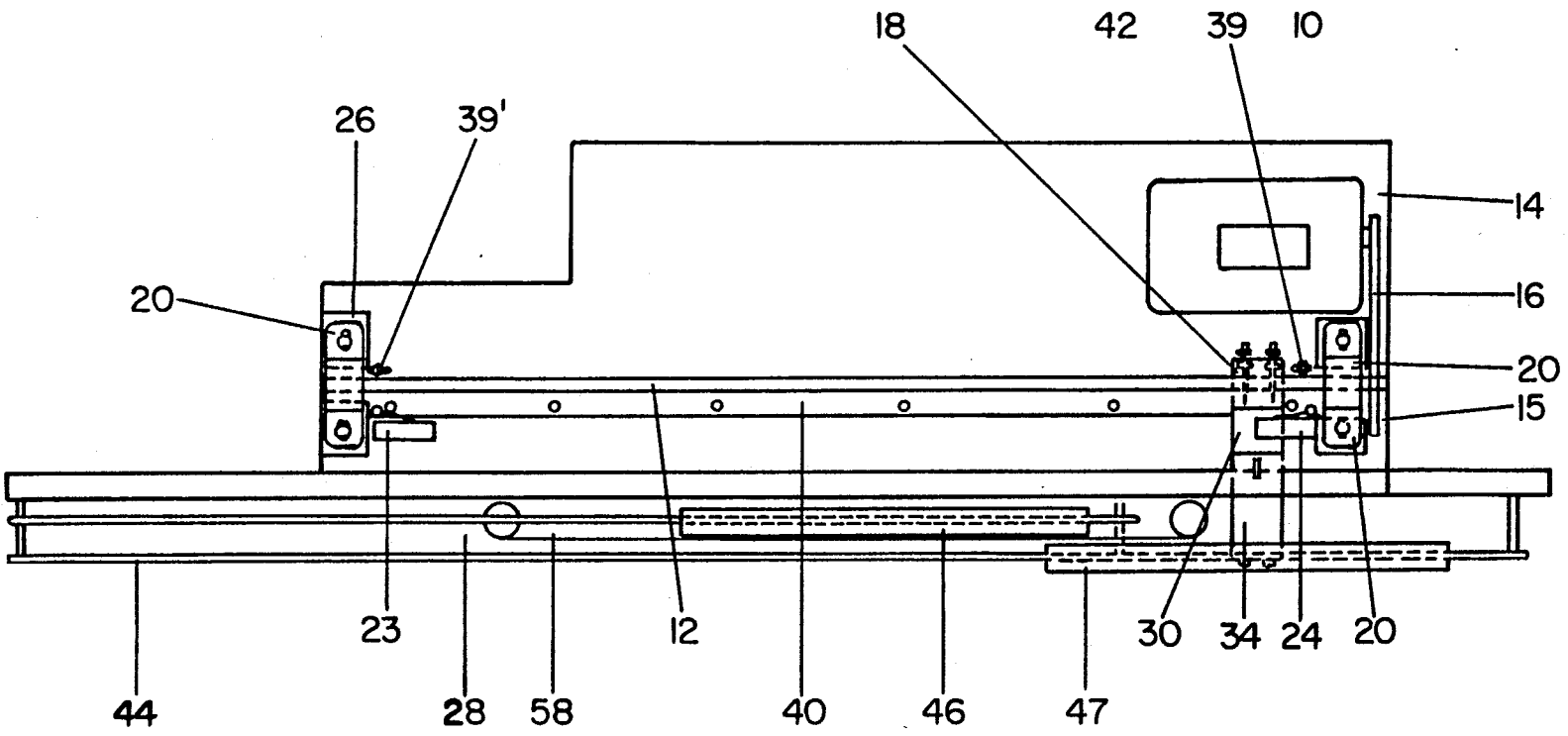
FIG. 2 is a top view of an embodiment of the present invention.

The linear actuator 18 has six (6) ball bearings 17, three on each end of the block pitched at a lead in the range of about 0.20 inch (0.51 cm) to 1 inch (2.54 cm), because the pitch of the bearings is directly proportional to the diameter of the shaft. A revolution of the shaft will move the linear actuator from 0.20 inch (0.51 cm) to 1 inch (2.54 cm) of the diameter of the shaft. The preferred lead is about 0.50" (1.27 cm). As shown in FIG. 2, the shaft 12 is attached to two resilient isolated pillow blocks 20. The pillow blocks 20 are attached to aluminum angles 26 and bolted to a bed plate 42. The combination of rubber isolated pillow blocks 20 and aluminum angles 26 decreases the resonant vibration of the mechanism and thus provides acceptable noise levels when the elevator doors are operating in the opening or closing cycle. Bed plate 42 is provided with a pair of slotted openings (not shown) in which bolts 39 and 39' are inserted. The slot is parallel to shaft 12 to provide lateral adjustment of each bolt. The bolts are fastened to the bed plate in any conventional manner and function to prevent actuator 18 from striking the pillow blocks.

Figure 3:
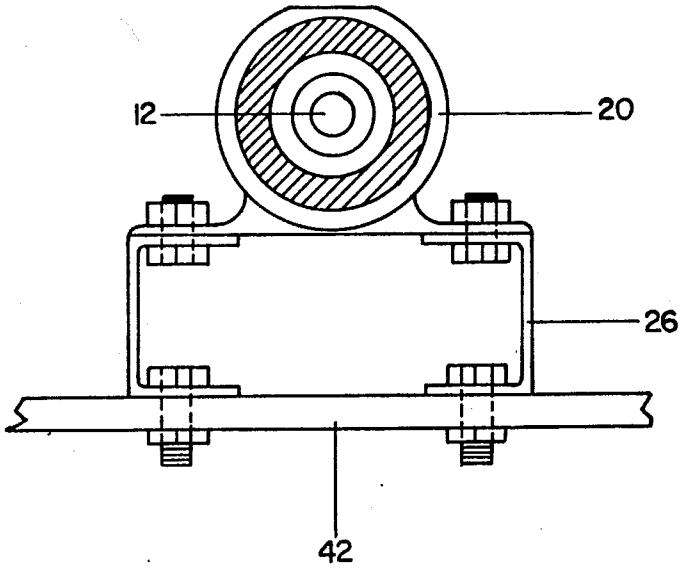
FIG. 3 is an end view of the elements of the invention that effectively dampen noise of operation of the elevator doors.

As shown in FIGS. 1, 2 and 3 the linear actuator 18 is attached to the two speed elevator doors 46 and 47 by two angles 30 and 34 that form the door drive assembly. Drive assembly angle 30 is connected directly to linear actuator 18 by a fastening means 27, such as rivets, sheet metal screws, or a cap screw and coupled with a coupling means 32 such as cap screws, sheet metal screws, rivets or a nylon isolation bushing to drive assembly angle 34 that is attached with cap screw 28 to the fast door 47 hanger bracket 49. The drive assembly angles 30 and 34 are bolted to the fast speed door 47 that propel the doors horizontally by the movement of linear actuator 18. The fast door 47 is coupled to the slow door 46 by a cable assembly 58. Preferably, the cable assembly 58 is a 2:1 cable assembly, because it permits a maximum opening with a minimum width of the door panels.

The entire door operator mechanism is attached to a bed plate 42. The bed plate 42 can be made of cold rolled steel, formed steel, galvanized sheet metal, aluminum, wood or plastic. Preferably, the bed plate 42 is aluminum or cold rolled steel. Between bed plate 42 and base of motor 10 is located a rubber isolation pad 22 to decrease vibration transfer. The door operating mechanism is mounted on top of the elevator attached to the two-speed door tracks mounting angle 52. The doors are guided by rollers 50, such as Neoprene TM lined ball bearing rollers, that are attached to hanger bracket 48 and 49. To stabilize the linear actuator 18, two cam followers 38 are attached to an angle 36 that is connected to the linear actuator 18 by cap screw 27. The cam followers 38 are attached to an angle 36 that is connected to linear actuator by cap screw 27. The cam followers 38 are guided along a stabilizing angle 40 that is attached to the bed plate 42. This restricts the torquing motion of linear actuator 18 and guides it along a level, straight path. With the activation of the drive motor 10 and the rotation of the stainless steel shaft 12, the linear actuator 18 will move along the solid shaft 12 at a precise speed. The adjustment springs 19 on linear actuator 18 are adjusted to reduce the kinetic energy on the moving mass to under about 2.5 ft-lbs (3.39 newton-meters) to conform with industry standards, and eliminate the necessity of any door protection reversing devices being used with the present invention.

Figure 4:
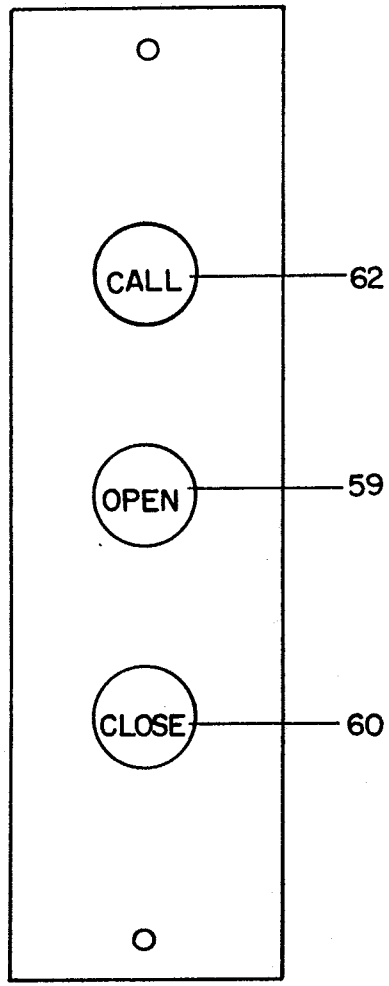
FIG. 4 is a view of the door open, the door close and the car call buttons.

The present invention allows automatic operation of the doors by activation of control devices that operate open and close relays, such as garage door openers, radio servo; motors, photo electric cells or open and close push buttons. The most preferred are an open push button 59 and close push button 60 to open and close the doors in the hall, adjacent to the entrance to the elevator, and in the cab in the car operating panel, as shown in FIG. 4. As is well known in the art, the standard procedure for calling or sending an elevator to a specific floor is activation of a call button shown as numeral 62. With the activation of electrical controls, the doors 46 and 47, when in the fully closed position, will open the full width of the elevator cab, i.e., 34 inches (86.36 cm). The opening direction is stopped at an adjustable distance by a first switching means 23. When the doors 46 and 47 are in the fully open position, the doors will close automatically by activation of the door close button 60 and are stopped at an adjustable distance by a second switching means 24. Both switching means 23 and 24 are preferably micro-switches. When a passenger exits the elevator, the doors will close automatically after a predetermined time by automatic activation of a standard timed delay relay (not shown) which is part of the elevator control, and the doors will be stopped at an adjustable distance by the activation of door close micro-switch 24. The doors are adjusted to under 2.5 ft-lbs by adjustment of set screws 13 on the linear actuator 18 that compress springs 19. The pressure of springs 19 will determine the force (in pounds) that pitched bearings 17 will exert on shaft 12. The pressure on shaft 12 is directly proportional to the slippage if an obstruction occurs in the linear movement of actuator 18. This process eliminates the need for any supplemental door protection devices.

The doors 46 and 47 use a guidance system such as that which is well known in the industry, i.e., aluminum extruded sills with nylon guide gibs on the bottom of the doors, that restrict any lateral movement. Neoprene rubber lined ball bearing door rollers 50 are guided on door tracks 44 that are connected to hanger brackets 48 and 49 and are bolted 54 and 56 to elevator cab doors 46 and 47.

Figure 5:
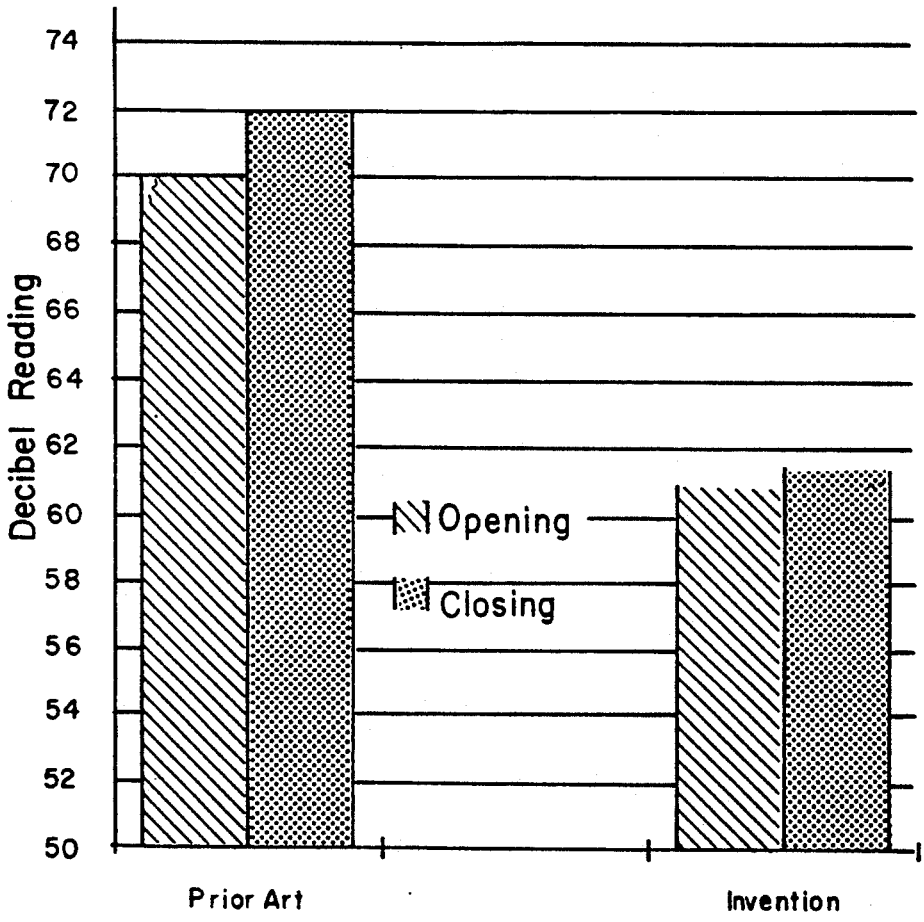
FIG. 5 is a chart showing sound levels for two sets of elevator door operators, one provided with the present invention and the other illustrative of the prior art.

FIG. 5 graphically illustrates the reduced sound level of an elevator mechanism constructed in accordance with the present invention. Ten decible readings were taken inside the cab of an elevator as the doors opened and closed. One reading was taken as the elevator door opened and a second reading was taken as the door closed. The first set of opening and closing measurements were taken on an elevator door mechanism which did not contain the present invention. A second set of readings, taken inside the elevator cab, were taken as the elevator door opened and closed. These readings were taken after the present invention was installed on the elevator door mechanism. Prior to installing the present invention, the door opening decibel reading was in the range of 68–72. After the invention was installed, the decibel reading decreased to the range of 60–62, similarly the door closing decibel reading was in the range of 70–74 before the invention was installed, after installation, the door closing reading was in the decibel range of 61–62. It is well known that a 10 decibel decrease is equivalent to a 50% reduction in noise level.

We claim:

1. An elevator door mechanism for use in a private residence comprising (a) a rotating shaft, (b) a reversible driving means to turn the shaft, (c) a linear drive actuator riding on and moving along the shaft, (d) a resilient isolated pillow block mounted on spacers at each end of the shaft to dampen the noise of operation, (e) two elevator doors attached to the linear drive actuator, and (f) a switching means attached to one end of the rotating shaft to close the door, wherein the actuator is attached to the shaft with pitched bearings and the closing force of the linear actuator is controlled by pressure springs on the linear actuator.

2. The mechanism of claim 1, wherein the rotating shaft is selected from the group consisting of steel, hardened steel or non-hardened stainless steel.

3. The mechanism of claim 1, wherein the reversible driving means is selected from the group consisting of an electric motor, an electric motor with gear reduction, or an electric motor with rpm reduction sheaves.

4. The mechanism of claim 1, wherein the linear drive actuator is a size 3 with six ball bearings, wherein the ball bearings are mounted three at each end of a two piece aluminum block.

5. The mechanism of claim 1, wherein the resilient isolated pillow block is an isolated bearing made of rubber.

6. The mechanism of claim 1, wherein the elevator doors are made of materials selected from the group consisting of steel, plastic, hollow core wood, or solid core wood.

7. The mechanism of claim 1, wherein the switching means is a switch having an instantaneous on/off mechanism and which is activated by use of a roller mounted to an end of the mechanism.

* * * * *

UNITED STATES PATENT AND TRADEMARK OFFICE

CERTIFICATE OF CORRECTION

PATENT NO. : 5,323,876

DATED : June 28, 1994

INVENTOR(S) : E.C. McAllister and J.L. Perron

It is certified that error appears in the above-identified patent and that said Letters Patent is hereby corrected as shown below:

On the Title page, item [76]; line 2

Replace the middle initial "C" with --L--.

(The second named inventor should be Jerome L. Perron)

Signed and Sealed this

Eleventh Day of April, 1995

*Attest:*

Bruce Lehman

BRUCE LEHMAN

*Attesting Officer*

*Commissioner of Patents and Trademarks*